United States Patent [19]

Black

[11] 4,417,116

[45] Nov. 22, 1983

[54] MICROWAVE WATER HEATING METHOD AND APPARATUS

[76] Inventor: Jerimiah B. Black, P.O. Box 31774–2065, Church Creek Dr., Charleston, S.C. 29407

[21] Appl. No.: 298,533

[22] Filed: Sep. 2, 1981

[51] Int. Cl.[3] ..... H05B 6/78

[52] U.S. Cl. ..... 219/10.55 A; 219/10.55 R; 219/10.55 M, 298

[58] Field of Search ..... 219/10.55 R, 10.55 A, 219/10.55 B, 10.55 M, 10.51, 298, 314, 341, 309

[56] References Cited

U.S. PATENT DOCUMENTS

| | | | |
|---|---|---|---|
| 703,970 | 7/1902 | Quain | 219/298 X |
| 1,685,364 | 9/1928 | Kopatz | 219/309 |
| 1,696,758 | 12/1928 | Galdi et al. | 219/298 X |
| 2,483,154 | 9/1949 | Rycroft | 219/341 |
| 3,816,689 | 6/1974 | Long | 219/10.55 R |
| 4,029,927 | 6/1977 | McMillan | 219/10.55 R |
| 4,114,011 | 9/1978 | Stubbs | 219/10.55 R X |
| 4,152,567 | 5/1979 | Mayfield | 219/10.55 A |
| 4,236,056 | 11/1980 | Allen et al. | 219/10.55 A |
| 4,358,652 | 11/1982 | Kaarup | 219/10.55 A |

*Primary Examiner*—B. A. Reynolds
*Assistant Examiner*—Philip H. Leung
*Attorney, Agent, or Firm*—Wigman & Cohen

[57] ABSTRACT

A method of and apparatus for heating liquids such as water utilizing microwave energy is disclosed. A microwave fluid heater system comprising a microwave-transparent fluid conductor body is arranged in a microwave-reflective and heat-insulated chamber. The conductor body is provided with a plurality of passages through which the fluid to be heated flows. At least one microwave source is arranged in one wall of the microwave chamber to radiate the fluid conductor body so that fluid passing through the passages in the body is heated primarily by absorption of microwave energy. A water distribution system for a building is also disclosed in which a plurality of microwave fluid heaters are arranged at different locations, each heater being adapted to supply hot or cold water independently of the other heaters.

8 Claims, 3 Drawing Figures

MICROWAVE WATER HEATING METHOD AND APPARATUS

BACKGROUND OF THE INVENTION

The present invention relates to a method of and apparatus for heating liquids such as water utilizing microwave energy and more particularly to an improved method and apparatus for increasing the energy absorption of the liquid medium.

A search of the prior art directed broadly to the concept of heating fluids with microwave energy failed to uncover any prior art reference which discloses the method and apparatus of the present invention. A number of patents were collected which disclose various systems, devices and processes for heating fluids with microwave energy and are listed hereinafter as follows:

| | | | |
|---|---|---|---|
| 2,585,970 | 3,668,358 | 3,891,817 | 4,152,567 |
| 2,978,562 | 3,754,111 | 3,920,945 | 4,165,455 |
| 3,535,482 | 3,778,578 | 3,963,892 | 4,178,494 |
| 3,607,667 | 3,812,315 | 4,029,927 | 4,236,056 |
| 3,663,783 | 3,816,689 | 4,114,011 | |

Typically, in the prior art microwave water heater apparatus, the water is either stored in a tank or container of a given volume and radiated by microwave energy from a magnetron or the like, such as shown in U.S. Pat. Nos. 3,891,817; 3,920,945; 4,029,927; 4,152,567; and 4,165,455, or is passed through a coiled tube or other tubular configuration upon which microwave energy is directed, such as the devices disclosed in U.S. Pat. Nos. 2,978,562; 3,778,578; 3,812,315; 3,816,689; 4,114,011; and 4,236,056.

The tank-or container-type devices disadvantageously result in uneven heating and wasted energy when, for example, the entire volume of water in the tank is heated to the required temperature and maintained at a high temperature even though only a small volume of water may be needed. The tubular coil-type devices, on the other hand, provide more even heating of the water and less wasted energy because, generally speaking, (1) the residence time of all water passing through the microwave energy field is relatively uniform and (2) large volumes of heated water are not stored indefinitely, but only slightly more water than the volumetric demand is heated.

However, one important disadvantage of the tubular coil-type devices is the loss of heat radiated from the large external surface area of the pipes, tubes and conduits carrying the heated water. Unless the pipes, tubes and conduits are individually insulated, they will radiate a substantial amount of heat into the surrounding microwave cavity resulting in wasted heat energy. Microwave water heater manifolds comprising a plurality of interconnected conduits are also disadvantageously subject to leakage at tubing joints, especially at the high heating rates involved in the microwave heating of water.

SUMMARY AND OBJECTS OF THE INVENTION

In view of the foregoing limitations and shortcomings of the prior art devices, as well as other disadvantages not specifically mentioned above, it should be apparent that there still exists a need in the art for an improved, energy-efficient microwave fluid heating method and a system which is capable of providing a substantially unlimited supply of hot water at a preselected temperature for domestic or commercial purposes. It is, therefore, a primary objective of this invention to fulfill that need by providing a compact microwave fluid heater of the character described which includes a novel apparatus for conducting fluid through a microwave energy field in which the fluid absorbs microwave energy and is heated thereby.

More particularly, it is an object of this invention to provide a novel fluid conductor for a microwave water heater apparatus which comprises a body of substantially microwave-transparent material having a plurality of parallel bores extending therethrough, the ends of the bores being in fluid communication with a respective fluid distributor or collector cavity sealed to each end of the fluid conductor body.

It is another object of this invention to provide a fluid conductor body for a microwave water heater which is constructed so as to minimize radiation of heat to the surroundings and to maximize conduction of heat from the conductor body to the relatively cool fluid entering the body.

Yet another object of the invention is to provide a fluid conductor for a microwave water heater in which the water travels in a plurality of passages in one direction through the microwave cavity at a velocity substantially less than the velocity of the fluid at the inlet to and outlet from the fluid conductor.

Still another object of the present invention is to provide a compact and remarkably simple, yet safe and effective, system for heating fluids, especially water for domestic purposes, utilizing microwave energy.

It is another object of the present invention to provide an energy-efficient method of heating a fluid utilizing microwave energy by conducting a fluid through a microwave energy field in such a way as to minimize radiation of heat to the surroundings and to maximize conduction of heat to the relatively cool fluid entering the microwave energy field.

As used herein the term "microwave energy" is intended to include electromagnetic radiation at frequencies above about 400 megahertz up to about 20,000 megahertz.

Briefly described, the aforementioned objects are accomplished according to the method and apparatus aspects of the invention by providing a microwave fluid heater system comprising a microwave-transparent fluid conductor body arranged in a microwave-reflective and heat-insulated chamber or housing. The conductor body is provided with a plurality of passages through which the fluid flows. At least one microwave source, such as a magentron, which generates high frequency electromagnetic radiation, is arranged in one wall of the microwave cavity to radiate the fluid conductor body so that fluid passing through the passages in the body is heated primarily by absorption of the microwave energy.

A domestic water supply, for example, may be heated with the system of the present invention and flow and thermostatic controls, as well as fluid surge tanks, safety valves, electrical circuit breakers and the like are provided to ensure safe operation of the system.

The fluid conductor comprises a body of plastic, ceramic or vitreous material which is substantially transparent to microwave radiation and can withstand temperatures somewhat above the boiling point of water. A preferred material is relatively pure borosilicate glass of the type used to make heat resistant cookware. Other materials may also be utilized, including vitreous materials, such as fused silica (silicon dioxide), vitreous silica, (fused quartz), polymeric plastic material, such as polytetrafluoroethylene, high density polyethylenes, polyurethanes, and ceramic materials. The material used for the conductor body should not include fillers, particularly metallic particles, or other particulate matter which absorbs any significant amount of microwave energy. Such particulate matter, including impurities which absorb microwave energy, not only can result in inefficient utilization of the microwave energy, but also can cause excessive heating of the conductor body to dangerous levels.

According to the present invention, the only significant heat energy supplied to the conductor body is by thermal conduction from the microwave-heated water body. Advantageously, that heat energy is substantially retained by the conductor body by conductor through the body toward the cooler inlet end of the body.

With the foregoing objects and other objects, advantages and features of the invention that will become hereinafter apparent, the nature of the invention may be more clearly understood by reference to the following detailed description of the invention, the appended claims and to the several views illustrated in the attached drawings.

DETAILED DESCRIPTION OF A PREFERRED EMBODIMENT

Figure 1:
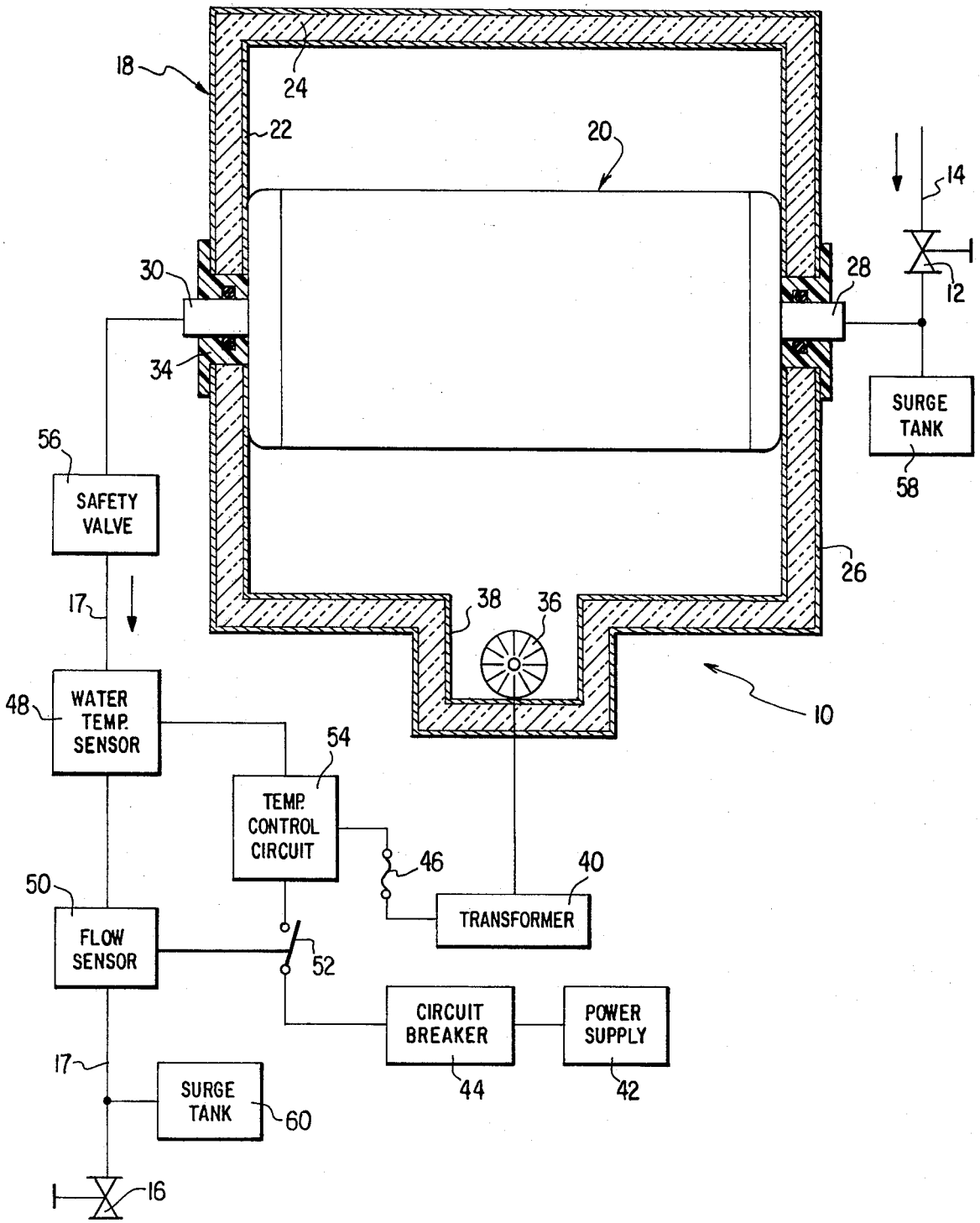
FIG. 1 is a partly schematic block diagram of the microwave fluid heater system of the present invention.

Referring now in detail to the drawings, there is illustrated in FIG. 1 a preferred embodiment of the microwave fluid heating system of the present invention which is designated generally by reference numeral 10. The system 10 is sufficiently compact, e.g., about one cubic foot, so as to be conveniently and readily connected in-line with the potable water supply line of a residence or business.

In the illustrated embodiment, the system 10 is arranged between a pair of conventional shut-off valves comprising a cold water inlet valve 12 connected to water supply line 14 and a hot water outlet valve 16, which may be a domestic hot water tap, connected to the hot water line 17 from the microwave water heater system.

System 10 includes a microwave chamber 18 which encloses at least one fluid conductor 20 through which the fluid to be heated, e.g., water, passes. The chamber 18 comprises a shell 22 formed of microwave reflective material, such as sheet metal, surrounded by a suitable heat insulating layer 24 and a further exterior housing or enclosure 26 which is made of a rigid plastic or metal material, such as fiberglass or aluminum.

The fluid conductor 20 is provided with a tubular inlet 28 and tubular outlet 30 which are sealingly supported in a pair of flanges 32, 34, respectively, mounted in opposite sidewalls of the microwave chamber 18. If desired, the inlet and outlet may pass through any wall and the space between the fluid conductor 20 and the inner reflective shell 22 may advantageously be provided with a shock-absorbing support which must be substantially transparent to microwave radiation and also have good thermal insulation properties.

Microwave energy for heating the water passing through fluid conductor 20 from inlet 28 to outlet 30 is generated by a microwave generator 36 which may be either a magnetron or a klystron tube. The microwave generator 36 is arranged in a waveguide 38 integrally formed with the microwave chamber 18.

Power is supplied to the microwave generator 36 from a high voltage transformer 40 which receives power from a power supply 42 via circuit breaker 44, fuse 46 and certain temperature and flow control circuits. The temperature and flow control circuits comprise a conventional water temperature sensor 48 and flow sensor 50 arranged in the hot water line 17. Flow sensor 50 is connected to a switch 52 in the power circuit to the microwave generator 36 such that the switch 52 is closed permitting operation of the microwave generator only when fluid flows in the hot water line 17. Interruption of fluid flow in line 17 for any reason will automatically interrupt the power circuit to the microwave generator 36. Thus, as soon as either valve 12 or 16 is shut off, the irradiation of the water in the fluid conductor with microwave energy terminates so that excessive heat and pressure in the system 10 is prevented.

Water temperature sensor 48 is connected to a variable temperature control circuit 54 which is of well-known construction. The sensor 48 and control circuit 54 may, for example, comprise a conventional, manually adjustable thermostat which is connected in circuit with the power supply to the microwave generator 36. As those skilled in the art will appreciate, the thermostat may be used to control the power to the magnetron by controlling the current supplied to the transformer 40 in proportion to preselected various temperature settings from cold to hot.

A safety device may be incorporated which may be optionally used to return the temperature control to the cold position automatically after a predetermined period of time after water flow has stopped. For further safety purposes, the system 10 is also provided with a pressure release safety valve 56 and surge tanks 58, 60 located adjacent the water inlet and outlet valves 12, 16, respectively.

Figure 2:
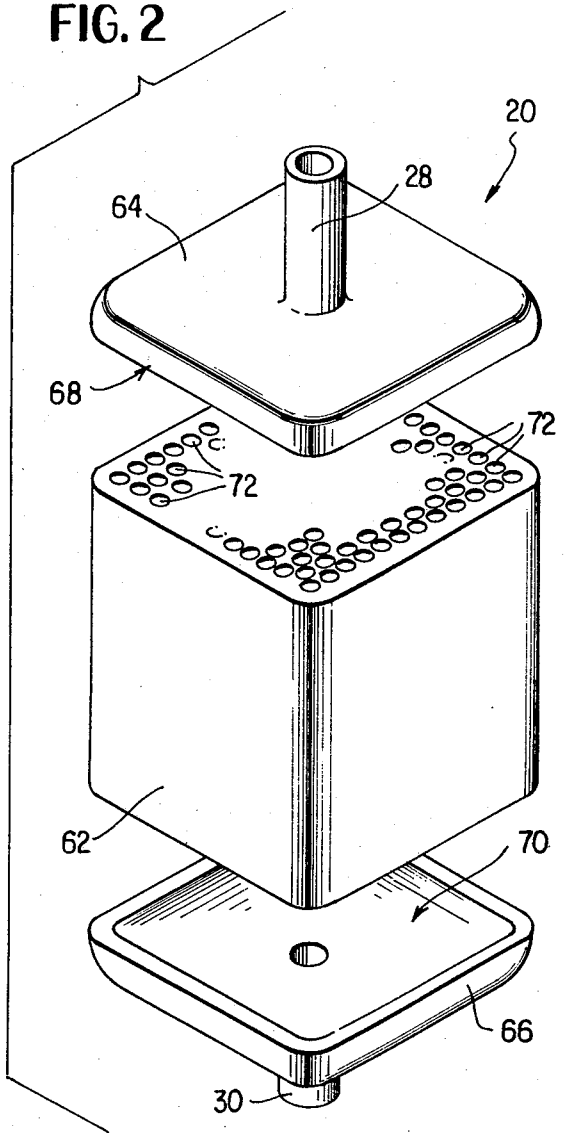
FIG. 2 is an exploded perspective view of the fluid conductor body of the present invention.

Referring now to FIG. 2, there is illustrated, in an exploded perspective view, the fluid conductor 20 of the present invention which comprises a polyhedron fluid conductor body 62 having a pair of end covers 64, 66 adapted to be fused or otherwise sealed to the ends of the body. Covers 64, 66 are provided with cavities 68, 70 which function as a cold water distributor and a hot water collector, respectively. The tubular inlet 28 and outlet 30 are integrally formed centrally of the respective end covers 64, 66.

A plurality of parallel through bores 72 is molded, drilled or otherwise formed parallel to the axis of the conductor body 20 so that water entering the tubular inlet 28 is distributed from end cover cavity 68 substantially uniformly among the bores 72, passing through the bores to the hot water collector cavity 70 and thence through tubular outlet 30. The longitudinal edges of the body 62 are rounded to avoid sharp, easily damaged edges.

The fluid conductor body 62 and the end covers 64, 66 are preferably formed of substantially microwave transparent boro-silicate glass and are fused together along the mating perimetrical surfaces of the body 62 and the end covers 64, 66. It is also possible to seal the end covers to the conductor body by means of conventional sealing arrangements, such as gaskets, sealing rings or the like, and the end covers may be formed of a material different from the material of the fluid conductor body 62. In addition, the fluid conductor body may be in cylindrical form with the end covers shaped accordingly.

In an exemplary embodiment of the fluid conductor 20 shown in FIG. 2, the body 62 has a square transverse cross-section of 7-inches on a side and 8-inch longitudinal or axial length. The inside diameter of the tubular inlet and outlet 28, 30 is ½-inch and 126 parallel bores of ⅛-inch diameter each are provided lengthwise through the conductor body 62. Assuming laminar flow of water through the fluid conductor, the water velocity through the ½-inch diameter inlet will be reduced by a factor of about 8, thereby substantially slowing the velocity of water through the conductor body 62 but not the volumetric flow rate and increasing the residence time of the water in microwave chamber 18 by a corresponding factor of about 8. To further reduce the fluid velocity, the holes 72 may be either enlarged or increased in number.

In addition to increasing the residence time of the water in the microwave energy field, the conductor body 62 also radiates less heat from its external surfaces than would a plurality of individual tubular conduits or a tubular coil having the same total surface area in contact with the water, assuming the same materials, microwave energy levels and volumetric flow. It is axiomatic, for example, that the external surface area of a plurality of conduits is greater than the inside surface area of those conduits. On the other hand, in the exemplary embodiment of the fluid conductor body described above, the external area of the body which corresponds to the external surface area of the conduits, namely, the four sides parallel to the bores, is approximately one-half the total internal surface area of the bores 72.

Thus, heat conducted to the body 62 from the heated water is dissipated into the surrounding environment less rapidly than the heat conducted to a coil or a plurality of tubes having a corresponding internal area. Moreover, as the water passes through the bores 72, it becomes increasingly hotter toward the outlet end of the conductor body resulting in a greater conduction of heat to the body at the outlet end which, in turn, is conducted through the body in a direction toward the water inlet or in a direction countercurrent to the water flow. Such conduction of the heat flow in the longitudinal direction in the body also tends to minimize the amount of heat radiated into the surrounding environment.

It will be appreciated that the system of the present invention may be operated to deliver water over a wide range of temperature from ambient water temperature to the boiling point of water at 100° C. If desired, the system may also be used to produce steam, the only limitations being the temperature and pressure capability of the mechanical components, the control ranges of the temperature and flow control elements and the power capacity of the microwave energy generating components. In addition, it should be understood that more than one microwave generator could be used to supply microwave energy to the water and that a plurality of fluid conductors could be arranged in series or parallel in one or more microwave chambers.

Figure 3:
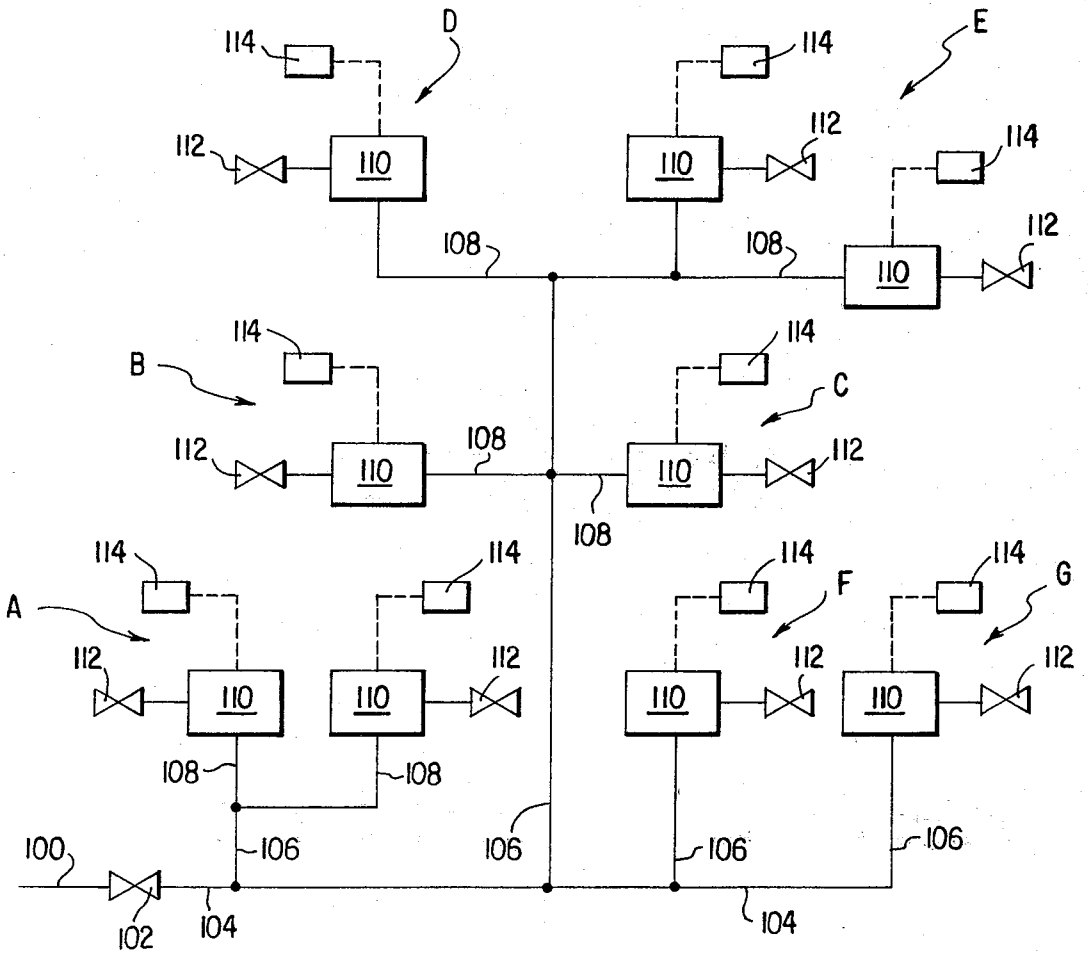
FIG. 3 is a schematic diagram of a water distribution system for a home employing the microwave water heater system of the invention.

A preferred arrangement of a building water distribution system employing the method and apparatus of the present invention is illustrated in FIG. 3. Water line 100 delivers water from a source, such as an underground municipal water main (not shown), to a main cut off valve 102 in a building, such as a private residence. From valve 102 a single water line 104 having multiple primary branches 106 and secondary branches 108 extending into various parts of the residence. For example, one branch line 106 delivers ambient temperature water to a full bath A where it is divided into two secondary lines 108 to a pair of independent microwave water heater systems 110 of the type shown in FIGS. 1 and 2.

Similarly, other primary and secondary branch lines 106, 108 supply ambient temperature water to a plurality of household locations, such as half baths B, C and D, full bath E, kitchen F and laundry room G. In each of those locations, there is located another system 110 configured as shown in FIGS. 1 and 2. Each of the system 110 has a single outlet valve 112 from which water is delivered at any desired temperature from ambient temperature (cold) to a set upper temperature limit.

Water temperature is controllable at each system location by means of a manual dial or knob 114 which is used to set the temperature control circuit (54 in FIG. 1) of the system 110 as described previously in connection with the system 10 of FIG. 1. As a safety feature, the manual dial or knobs 114 are preferably provided with a conventional locking device for preventing operation of the dial to cause heating of the water without first disengaging the locking device. Thus, the system is rendered safe for use in a home with small children.

It will be apparent to those skilled in the art that the arrangement of FIG. 3 advantageously eliminates one-half of the water plumbing necessary in a building inasmuch as only a single cold water supply line need be installed and fixtures, such as bath tubs, lavatories, sinks and the like require only a single faucet shut-off valve.

Although only a preferred embodiment is specifically illustrated and described herein, it will be appreciated that many modifications and variations of the present invention are possible in light of the above teachings and within the purview of the appended claims without departing from the spirit and intended scope of the invention.

What I claim is:

1. Apparatus for heating fluid, especially water, utilizing microwave energy comprising:

means for generating microwave energy;

means for defining a microwave chamber for containing the microwave energy generated by said generating means; and means in said microwave chamber means for conducting the fluid to be heated through the microwave energy, said fluid conducting means comprising a solid unitary block formed of a substantially microwave-transparent material, said block having a plurality of fluid passages extending therethrough, said fluid flowing through said passages directly contacting the microwave-transparent material of the solid unitary block, said block further comprising a pair of end covers formed of a substantially microwave-transparent material and sealingly mounted to respective ends of said unitary block, each end cover having a cavity enclosing the ends of said fluid passages and a conduit extending into said cavity, the total cross-sectional flow area of said fluid passages being at least twice the cross-sectional flow area of each of said conduits whereby the flow velocity through said fluid passages is substantially less than the flow velocity through said conduits.

2. Apparatus according to claim 1, wherein said fluid passages extend in substantially parallel relation through said unitary body from one end to another end thereof.

3. Apparatus according to claim 1, wherein said chamber means is provided with a pair of openings on opposite sides thereof through which a respective conduit extends, said chamber means comprising a reflective inner surface covered by a heat insulating material and surrounded by an outer housing.

4. Apparatus according to claim 1, wherein said unitary body is molded with said fluid passages formed therein of borosilicate glass.

5. Apparatus according to claim 1, including inlet and outlet conduits connected to said fluid conducting means, fluid flow sensing means arranged in said outlet conduit for interrupting said microwave generating means in response to zero flow conditions in said outlet conduit.

6. Apparatus according to claim 5, including a temperature sensor arranged in said outlet conduit, temperature control means connected to said temperature sensor for presetting the outlet temperature of the heated fluid and for interrupting said microwave generating means in response to a signal from said temperature sensor corresponding to the preset outlet temperature.

7. A fluid heating and distribution system for heating and delivering a fluid to a plurality of locations comprising:

a single fluid line for supplying ambient temperature fluid from a source to a plurality of locations;

a plurality of microwave fluid heating means, each being located in a respective one of said locations and utilizing microwave energy for heating the fluid delivered to each of said locations from said single fluid line, each of said fluid heating means having a fluid outlet, each of said heating means comprising means for generating microwave energy, means defining a microwave chamber for containing the microwave energy generated by said generating means, and means in said microwave chamber means for conducting the fluid to be heated through the microwave energy, said fluid conducting means comprising a solid unitary block formed of a substantially microwave-transparent material, said block having a plurality of fluid passages extending therethrough, said fluid flowing through said passages directly contacting the microwave-transparent material of the solid unitary block, said block further comprising a pair of end covers formed of a substantially microwave-transparent material and sealingly mounted to respective ends of said unitary block, each end cover having a cavity enclosing the ends of said fluid passages and a conduit extending into said cavity, the total cross-sectional flow area of said fluid passages being at least twice the cross-sectional flow area of each of said conduits whereby the flow velocity through said fluid passages is substantially less than the flow velocity through said conduits; and means associated with each of said microwave fluid heating means and operable for variably setting the temperature of the fluid delivered from said fluid outlet to a temperature between ambient fluid temperature and a predetermined maximum temperature.

8. A method for heating fluid, especially water utilizing microwave energy comprising:

flowing a fluid to be heated into a microwave chamber;

dividing the fluid into a plurality of parallel fluid flows, such that the cross-sectional flow area of the fluid flowing in said plurality of flows is at least twice the cross-sectional flow area of the fluid flow into the microwave chamber;

whereby the water velocity in said plurality of flows is substantially less than the velocity of water flowing into the microwave chamber, thus increasing the residence time of the water in the microwave chamber;

passing the plurality of flows in one flow direction in the microwave chamber through a substantially microwave-transparent heat conductive solid body having a plurality of fluid passages extending therethrough, said fluid directly contacting the heat conductive solid body;

heating the parallel fluid flows by irradiating the fluid with microwave energy; and conducting heat from the heated fluid through said body in a direction countercurrent to said one flow direction.

* * * * *